US011373829B2

(12) United States Patent
Huang et al.

(10) Patent No.: US 11,373,829 B2
(45) Date of Patent: Jun. 28, 2022

(54) ELECTROMAGNETIC RELAY

(71) Applicant: Tyco Electronics (Shenzhen) Co. Ltd, Shenzhen (CN)

(72) Inventors: Zhihong Huang, Shenzhen (CN); Kun Tang, Shenzhen (CN); Zhenxing Fu, Shenzhen (CN)

(73) Assignee: Tyco Electronics (Shenzhen) Co. Ltd., Shenzhen (CN)

( * ) Notice: Subject to any disclaimer, the term of this patent is extended or adjusted under 35 U.S.C. 154(b) by 197 days.

(21) Appl. No.: 16/587,350

(22) Filed: Sep. 30, 2019

(65) Prior Publication Data

US 2020/0105489 A1 Apr. 2, 2020

(30) Foreign Application Priority Data

Sep. 30, 2018 (CN) ..... 201811155249.4

(51) Int. Cl.

| | |
|---|---|
| ***H01H 3/00*** | (2006.01) |
| ***H01H 50/44*** | (2006.01) |
| ***H01H 50/02*** | (2006.01) |
| ***H01H 50/18*** | (2006.01) |
| ***H01H 50/36*** | (2006.01) |

(52) U.S. Cl.

CPC ..... *H01H 50/44* (2013.01); *H01H 50/02* (2013.01); *H01H 50/18* (2013.01); *H01H 50/36* (2013.01)

(58) Field of Classification Search

CPC ..... H01H 50/44; H01H 50/02; H01H 50/18; H01H 50/36; H01H 51/06; H01H 50/042; H01H 50/642; H01H 2050/367; H01H 50/58

USPC ..... 335/185

See application file for complete search history.

(56) References Cited

U.S. PATENT DOCUMENTS

| | | | | | |
|---|---|---|---|---|---|
| 4,346,359 | A * | 8/1982 | Pirner | H01H 51/06 | 335/202 |
| 4,689,587 | A * | 8/1987 | Schroeder | H01H 50/18 | 335/128 |
| 5,041,870 | A * | 8/1991 | Imai | H01H 50/26 | 335/83 |
| 5,160,910 | A * | 11/1992 | Tsuji | H01H 50/642 | 335/121 |
| 5,204,647 | A * | 4/1993 | Mitsuki | H01H 50/043 | 335/128 |
| 5,289,145 | A * | 2/1994 | Schedele | H01H 50/026 | 335/128 |
| 5,392,015 | A * | 2/1995 | Matsuoka | H01H 1/50 | 335/130 |

(Continued)

FOREIGN PATENT DOCUMENTS

| | | |
|---|---|---|
| CN | 101236863 A | 8/2008 |
| CN | 101689443 A | 3/2010 |

(Continued)

*Primary Examiner* — Shawki S Ismail
*Assistant Examiner* — Lisa N Homza
(74) *Attorney, Agent, or Firm* — Barley Snyder

(57) ABSTRACT

An electromagnetic relay includes a base, a spool provided on the base, a coil wound on the spool, a yoke inserted into a hole formed in the spool, an armature movably provided on the base, a movable contact fixed on the base, a static contact fixed on the base, and a driving member connected between the armature and the movable contact. The yoke is L-shaped. The yoke and the armature form a rectangular magnetic loop.

20 Claims, 3 Drawing Sheets

(56) References Cited

U.S. PATENT DOCUMENTS 5,396,204 A * 3/1995 Matsuoka ..... H01H 50/04 335/78
5,572,176 A * 11/1996 Heinzl ..... H01H 50/642 335/129
5,719,541 A * 2/1998 Mader ..... H01H 50/642 335/78
5,781,089 A * 7/1998 Doneghue ..... H01H 50/026 335/128
5,790,004 A * 8/1998 Matsuoka ..... H01H 50/042 335/78
6,232,858 B1 * 5/2001 Reiter ..... H01H 50/18 335/128
6,496,090 B1 * 12/2002 Nishida ..... H01H 50/023 335/128
6,545,575 B1 * 4/2003 Hirabayashi ..... H01H 50/042 335/128
7,782,162 B2 * 8/2010 Nishida ..... H01H 50/56 335/201
8,111,117 B2 * 2/2012 Minowa ..... H01H 50/34 335/78
8,816,800 B2 * 8/2014 Mikl ..... H01H 50/64 335/83
9,076,617 B2 * 7/2015 Yamashita ..... H01H 9/443
9,711,310 B2 * 7/2017 Moriyama ..... H01H 50/026
9,754,747 B1 * 9/2017 Yeh ..... H01H 50/047
10,685,801 B2 * 6/2020 Shimoda ..... H01H 50/44
11,004,639 B2 * 5/2021 Wu ..... H01H 50/24
2002/0109569 A1 * 8/2002 Yamashita ..... H01H 50/443 335/129
2005/0151606 A1 * 7/2005 Nishida ..... H01H 9/443 335/128
2006/0091985 A1 * 5/2006 Mochizuki ..... H01H 50/54 335/128
2006/0181380 A1 * 8/2006 Nakamura ..... H01H 50/646 335/132
2008/0180197 A1 * 7/2008 Kubono ..... H01H 50/443 335/78
2010/0060396 A1 * 3/2010 Mikl ..... H01H 50/44 335/299
2012/0206223 A1 * 8/2012 Tan ..... H01H 51/2272 335/189
2016/0027602 A1 * 1/2016 Hasegawa ..... H01H 50/58 335/189
2018/0130625 A1 * 5/2018 Kubono ..... H01H 50/56
2018/0144895 A1 * 5/2018 Shimoda ..... H01H 50/06
2021/0159036 A1 * 5/2021 Ikushima ..... H01H 50/24
2021/0166904 A1 * 6/2021 Kato ..... H01H 50/36

FOREIGN PATENT DOCUMENTS

CN 105097360 A 11/2015
CN 106409611 A 2/2017
CN 107210164 A 9/2017
CN 206471294 U 9/2017
JP 2010231988 A 3/2009

* cited by examiner

ELECTROMAGNETIC RELAY

CROSS-REFERENCE TO RELATED APPLICATION

This application claims the benefit of the filing date under 35 U.S.C. § 119(a)-(d) of Chinese Patent Application No. 201811155249.4, filed on Sep. 30, 2018.

FIELD OF THE INVENTION

The present invention relates to a relay and, more particularly, to an electromagnetic relay.

BACKGROUND

An electromagnetic relay usually comprises a coil, an iron core inserted into the coil, a yoke riveted to the iron core, and an armature connected between the yoke and the iron core. When the coil is energized, an electromagnetic loop is formed among the yoke, the armature, and the iron core, and the armature moves under the action of electromagnetic force, thus realizing the switching action of electromagnetic relay.

The electromagnetic relay, however, includes too many components, which leads to a complex structure and low manufacturing efficiency. Moreover, because of too many components, excessive cumulative errors will result during assembling the electromagnetic relay, which is not conducive to the consistency of the function of the final products.

SUMMARY

An electromagnetic relay includes a base, a spool provided on the base, a coil wound on the spool, a yoke inserted into a hole formed in the spool, an armature movably provided on the base, a movable contact fixed on the base, a static contact fixed on the base, and a driving member connected between the armature and the movable contact. The yoke is L-shaped. The yoke and the armature form a rectangular magnetic loop.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
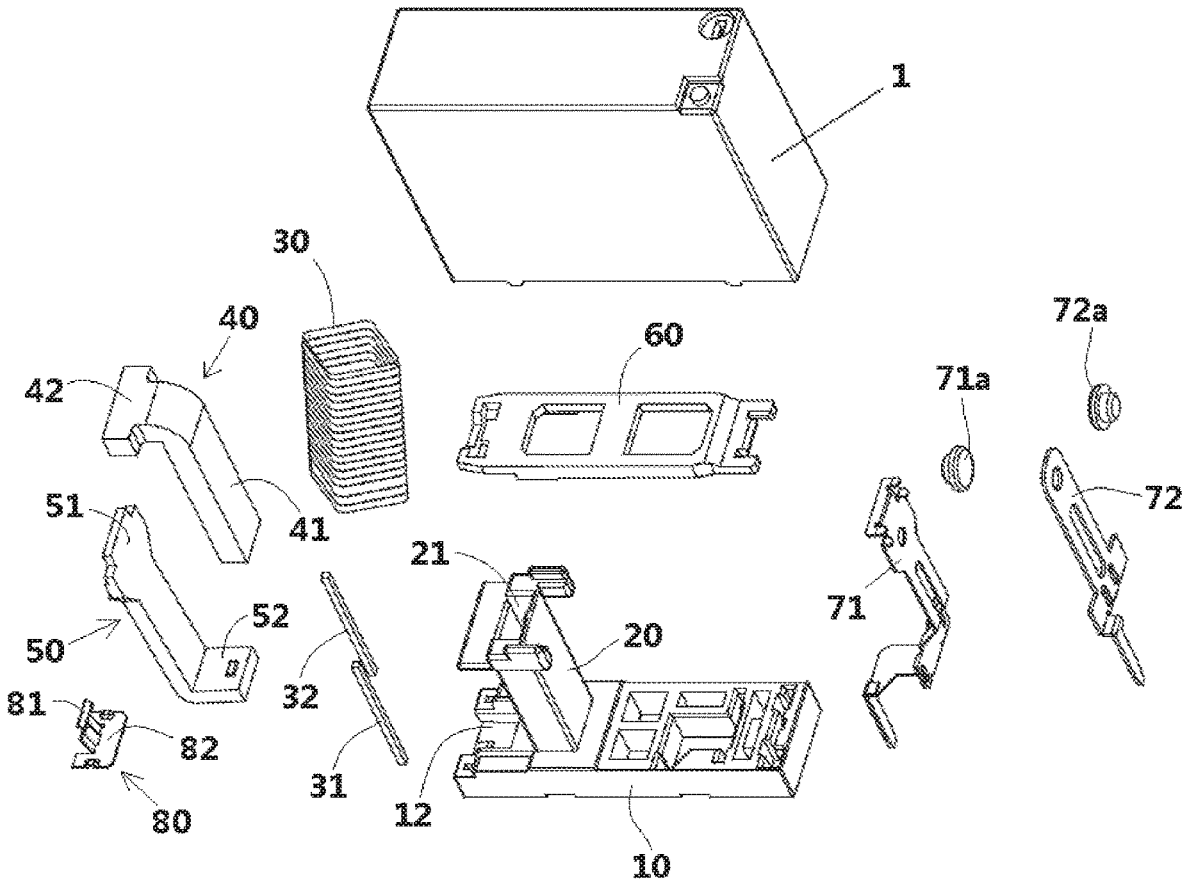
FIG. 1 is an exploded perspective view of an electromagnetic relay according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
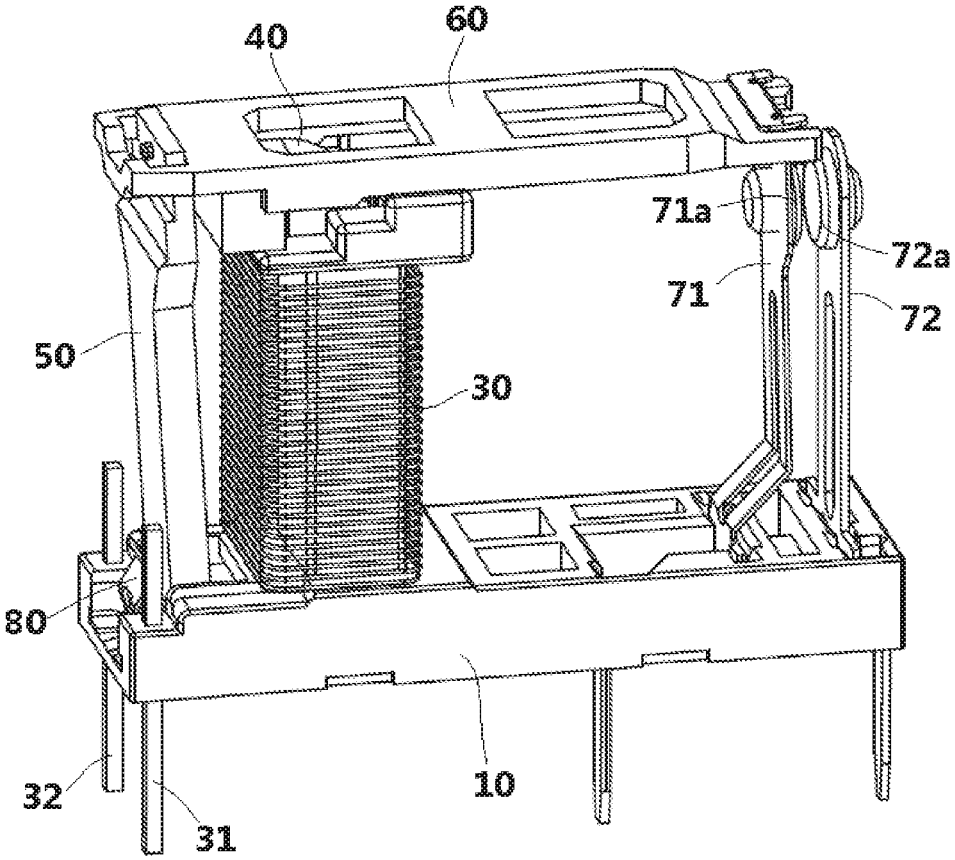
FIG. 2 is a perspective view of the electromagnetic relay in an assembled state.
Figure 3:
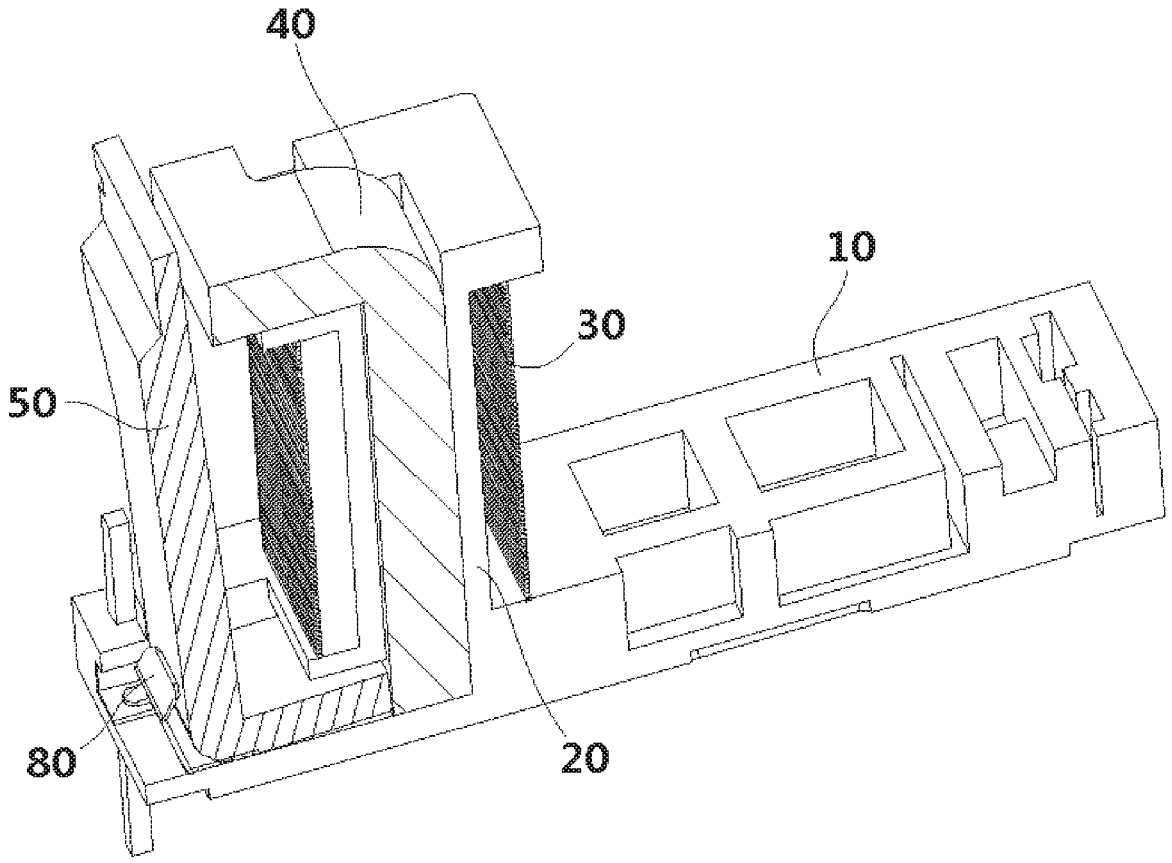
FIG. 3 is a sectional perspective view of the electromagnetic relay.

An electromagnetic relay according to an embodiment, as shown in FIGS. 1-3, comprises a base 10, a spool 20, a coil 30, a yoke 40, an armature 50, a movable contact 71, 71*a*, a static contact 72, 72*a*, and a driving member 60. The spool 20 is provided on the base 10. The coil 30 is wound on the spool 20. The yoke 40 is inserted into a hole 21 formed in the spool 20. The armature 50 is movably disposed on the base 10. The movable contact 71, 71*a* is fixed on the base 10. The static contact 72, 72*a* is fixed on the base 10. The driving member 60 is connected between the armature 50 and the movable contact 71, 71*a*.

In the embodiment shown in FIGS. 1-3, each of the yoke 40 and the armature 50 is L-shaped, and the yoke 40 and the armature 50 form a rectangular magnetic loop.

When the coil 30 is energized, the armature 50 drives the driving member 60 to move under the action of magnetic force, and the driving member 60 drives the movable contact 71, 71*a* to move towards the static contact 72, 72*a*, so that the movable contact 71, 71*a* electrically contacts the static contact 72, 72*a*. When the coil 30 is de-energized, the movable contact 71, 71*a* moves away from the static contact 72, 72*a* under the action of its elastic restoring force, so that the movable contact 71, 71*a* and the static contact 72, 72*a* are electrically separated.

As shown in FIGS. 1-3, the yoke 40 includes a main body 41 and an extension end 42 connected to an upper end of the main body 41 and perpendicular to the main body 41. The armature 50 includes a main body 51 and an extension end 52 connected to a lower end of the main body 51 and perpendicular to the main body 51. The main body 41 of the yoke 40 and the main body 51 of the armature 50 are arranged opposite to each other to form a first pair of opposite sides of the rectangular magnetic loop. The extension end 42 of the yoke 40 and the extension end 52 of the armature 50 are arranged opposite to each other to form a second pair of opposite sides of the rectangular magnetic loop. The extension end 42 of the yoke 40 is arranged to face the upper end of the main body 51 of the armature 50. The extension end 52 of the armature 50 is arranged to face the lower end of the main body 41 of the yoke 40.

As shown in FIGS. 1-3, the main body 41 of the yoke 40 is inserted into the hole 21 of the spool 20, and the extension end 42 of the yoke 40 is located outside the spool 20. The extension end 42 of the yoke 40 has a width larger than that of the main body 41 of the yoke 40, and the upper end of the main body 51 of the armature 50 has a width larger than a remainder of the main body 51 of the armature 50. In this way, an area of the extension end 42 of yoke 40 facing the upper end 51 of main body 51 of the armature 50 is increased, increasing the magnetic force between the extension end 42 of the yoke 40 and the upper end of the main body 51 of the armature 50.

In the shown embodiment, the base 10 and the spool 20 are formed as a single integral component. For example, in an exemplary embodiment, the base 10 and the spool 20 may be formed as a single injection molding component. The base 10 and the spool 20 need not be manufactured separately, and a step of assembling the spool 20 onto the base 10 is omitted.

As shown in FIG. 1, a receiving slot 12 is formed at one end of the base 10 near the spool 20, and the extension end 52 of the armature 50 is received in the receiving slot 12.

The electromagnetic relay, as shown in FIGS. 1-3, includes an elastic pressing member 80 that is fixed in the receiving slot 12 of the base 10 and pressed against the outer side of the lower end of the main body 51 of the armature 50, so as to position the armature 50 in the slot 12 and provide an auxiliary thrust to the armature 50. The elastic pressing member 80 is constructed to prevent the extension end 52 of the armature 50 from being moved to the outside of the slot 12, so that the armature 50 is positioned reliably in the receiving slot 12. The elastic pressing member 80 is adapted to exert a certain auxiliary thrust on the armature 50, and the auxiliary thrust together with the magnetic force acting on the armature 50 is used to push the armature 50 to swing. Thus, the magnetic force needed to drive the armature 50 to swing may be reduced.

The elastic pressing member 80, as shown in FIG. 1, has a base part 82 and an elastic sheet 81 connected to the base part 82. The base part 82 of the elastic pressing member 80 is located below the bottom surface of the extension end 52 of the armature 50 and fixed in the slot 12 in an interference fit manner. The elastic sheet 81 of the elastic pressing member 80 is elastically pressed against the outer side of the lower end of the main body 51 of the armature 50.

The movable contact 71, 71*a*, as shown in FIGS. 1 and 2, has a movable elastic arm 71 and a movable contact point 71*a* provided on an upper end of the movable elastic arm 71. A lower end of the movable elastic arm 71 is fixed on the base 10, for example, is assembled in a groove formed in the base 10. The static contact 72, 72*a* has a static elastic arm 72 and a static contact point 72*a* provided on an upper end of the static elastic arm 72. A lower end of the static elastic arm 72 is fixed on the base 10, for example, is assembled in a groove formed in the base 10. In the shown embodiment, the movable contact point 71*a* is formed as a separate contact component mounted on the movable elastic arm 71, and the static contact point 72*a* is formed as a separate contact component mounted on the static elastic arm 72. In other embodiments, the movable contact point 71*a* may be a convex part integrally formed on the movable elastic arm 71, and the static contact point 72*a* may be a convex part integrally formed on the static elastic arm 72.

As shown in FIGS. 1-3, the upper end of the armature 50 is inserted into a slot formed in a first end of the driving member 60, and a second end of the driving member 60 is inserted into a slot formed in the upper end of the movable elastic arm 71. In this way, the driving member 60 is connected between the armature 50 and the movable elastic arm 71.

The electromagnetic relay, as shown in FIGS. 1 and 2, comprises a pair of coil pins 31, 32 for electrically connecting the coil 10 to an external power supply. The pair of coil pins 31, 32 are fixed on the base 10 and electrically connected to the coil 10.

The electromagnetic relay, as shown in FIG. 1, comprises a housing 1 adapted to be hermetically assembled on the base 10. The coil 30, the yoke 40, the armature 50, the movable contact 71, 71*a*, the static contact 72, 72*a*, and the driving member 60 are sealed and contained in the housing 1.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An electromagnetic relay, comprising:

a base;

a spool provided on the base;

a coil wound on the spool;

a yoke inserted into a hole formed in the spool, the yoke is L-shaped and includes a main body and an extension end connected to an upper end of the main body and extending perpendicular to the main body, the extension end of the yoke has a width larger than the main body of the yoke;

an armature movably mounted on the base, the yoke and the armature form a rectangular magnetic loop, the armature includes a main body and an extension end connected to a lower end of the main body of the armature, an upper end of the main body of the armature has a width larger than a remainder of the main body of the armature, the widened extension end of the yoke is aligned with and faces the widened upper end of the main body of the armature;

a movable contact fixed on the base and on a side of the spool opposite the armature, the movable contact having a movable elastic arm including a lower end fixed on the base;

a static contact fixed on the base; and a driving member connected between the armature and an upper end of the movable elastic arm.

2. The electromagnetic relay of claim 1, wherein the armature is L-shaped.

3. The electromagnetic relay of claim 1, wherein the driving member is directly connected to the armature and the upper end of the moveable contact and, when the coil is energized, the armature drives the driving member to move under a magnetic force and the driving member drives the movable contact to move towards the static contact, so that the movable contact is brought into electrical contact with the static contact.

4. The electromagnetic relay of claim 3, wherein, when the coil is de-energized, the movable contact moves away from the static contact under an elastic restoring force of the movable contact, so that the movable contact and the static contact are electrically separated.

5. The electromagnetic relay of claim 1, wherein the extension end of the armature extends perpendicular to the main body of the armature.

6. The electromagnetic relay of claim 5, wherein the main body of the yoke and the main body of the armature are arranged opposite to each other to form a first pair of opposite sides of the rectangular magnetic loop, and the extension end of the yoke and the extension end of the armature are arranged opposite to each other to form a second pair of opposite sides of the rectangular magnetic loop.

7. The electromagnetic relay of claim 6, wherein the extension end of the armature is arranged to face a lower end of the main body of the yoke.

8. The electromagnetic relay of claim 7, wherein the main body of the yoke is inserted into the hole of the spool and the extension end of the yoke is located outside the spool.

9. The electromagnetic relay of claim 6, further comprising an elastic pressing member fixed to the base and pressed against an outer side of the lower end of the main body of the armature, the elastic pressing member positioning the extension end of the armature relative to the base and providing an auxiliary thrust to the armature.

10. The electromagnetic relay of claim 9, wherein the elastic pressing member has a base part and an elastic sheet connected to the base part, the base part of the elastic pressing member is below a bottom surface of the extension end of the armature and fixed within the base in an interference fit manner, the elastic sheet of the elastic pressing member is elastically pressed against the outer side of the lower end of the main body of the armature.

11. The electromagnetic relay of claim 1, wherein the base and the spool are a single integral component.

12. The electromagnetic relay of claim 11, wherein the single integral component is a single injection molding component.

13. The electromagnetic relay of claim 1, wherein the movable contact has a movable contact point disposed proximate the upper end of the movable elastic arm.

14. The electromagnetic relay of claim 13, wherein the static contact has a static elastic arm and a static contact point disposed on an upper end of the static elastic arm, a lower end of the static elastic arm is fixed on the base.

15. The electromagnetic relay of claim 14, wherein the movable contact point is a convex part integrally formed on the movable elastic arm or a contact component mounted on the movable elastic arm, the static contact point is a convex part integrally formed on the static elastic arm or a contact component mounted on the static elastic arm.

16. The electromagnetic relay of claim 1, further comprising a pair of coil pins adapted to electrically connect the coil to an external power supply, the pair of coil pins are fixed on the base and electrically connected to the coil.

17. The electromagnetic relay of claim 1, further comprising a housing assembled on the base, the coil, the yoke, the armature, the movable contact, the static contact, and the driving member are sealed and contained in the housing.

18. The electromagnetic relay of claim 1, further comprising an elastic pressing member arranged on the base and pressing against an outer side of the lower end of the main body of the armature.

19. An electromagnetic relay, comprising:

a base;

a spool provided on the base, a receiving slot formed at an end of the base near the spool;

a coil wound on the spool;

a yoke inserted into a hole formed in the spool, the yoke is L-shaped and includes a main body and an extension end connected to an upper end of the main body and extending perpendicular to the main body;

an armature movably provided on the base and including a main body and an extension end connected to a lower end of the main body of the armature and extending perpendicular to the main body of the armature, the extension end of the armature received in the receiving slot, the yoke and the armature form a rectangular magnetic loop, the main body of the yoke and the main body of the armature are arranged opposite to each other to form a first pair of opposite sides of the rectangular magnetic loop, and the extension end of the yoke and the extension end of the armature are arranged opposite to each other to form a second pair of opposite sides of the rectangular magnetic loop;

a movable contact fixed on the base;

a static contact fixed on the base;

a driving member connected between the armature and the movable contact and an elastic pressing member arranged on the base and pressing against an outer side of the lower end of the main body of the armature.

20. An electromagnetic relay, comprising:

a base;

a spool provided on the base;

a coil wound on the spool;

a yoke inserted into a hole formed in the spool, the yoke is L-shaped;

an armature movably provided on the base, the yoke and the armature form a rectangular magnetic loop;

a movable contact fixed on the base and having a movable elastic arm and a movable contact point disposed on an upper end of the movable elastic arm, a lower end of the movable elastic arm is fixed on the base;

a static contact fixed on the base and having a static elastic arm and a static contact point disposed on an upper end of the static elastic arm, a lower end of the static elastic arm is fixed on the base;

a driving member connected between the armature and the movable contact, an upper end of the armature is inserted into a slot formed in a first end of the driving member, a second end of the driving member is inserted into a slot formed in the upper end of the movable elastic arm and the driving member is connected between the armature and the movable elastic arm; and an elastic pressing member arranged on the base and pressing against an outer side of the armature.

* * * * *